United States Patent [19]

Braun, Jr.

[11] 4,383,340

[45] May 17, 1983

[54] RETROFIT WHIRLPOOL BATH HAVING FLOW DIRECTING RECESSES

[75] Inventor: Alfred J. Braun, Jr., San Jose, Calif.

[73] Assignee: Solar Heating & Spas, Inc., San Jose, Calif.

[21] Appl. No.: 214,038

[22] Filed: Dec. 8, 1980

[51] Int. Cl.[3] ..... A61H 9/00

[52] U.S. Cl. ..... 4/541; 4/542; 128/66

[58] Field of Search ..... 128/66, 64; 4/541, 542, 4/543, 544, 571, 573, 577, 580, 584, 589, 590; D23/55

[56] References Cited

U.S. PATENT DOCUMENTS

| | | | |
|---|---|---|---|
| D. 254,572 | 3/1980 | Reineman | 128/66 X |
| 2,828,489 | 4/1958 | Baker | 4/589 |
| 2,947,996 | 8/1960 | Neuman | 128/66 |
| 3,741,201 | 6/1973 | Oudkerk | 128/66 |
| 3,763,924 | 6/1973 | Jacuzzi | 128/66 |
| 3,845,759 | 11/1974 | Miklovic | 128/66 |
| 4,160,292 | 7/1979 | Kuether | 4/590 |
| 4,249,522 | 2/1981 | Carrier | 4/543 |

*Primary Examiner*—Richard J. Apley
*Assistant Examiner*—David J. Brown
*Attorney, Agent, or Firm*—Thomas E. Schatzel

[57] ABSTRACT

A retrofit whirlpool bath is described which includes an oblong tub having inwardly tapering side and end walls. The end walls each have a back supportive surface and each are provided with a wedge shaped recessed surface. One of the end walls is also provided with a vertical, semi-tubular recessed surface intersecting the wedge shaped recessed surface. The recessed surfaces include apertures receptive to water jet nozzles and are designed to enhance the pressure and turbulence of water flowing from the nozzles and to distribute the turbulent water against the back of a person reclining against the supportive surfaces.

11 Claims, 5 Drawing Figures

RETROFIT WHIRLPOOL BATH HAVING FLOW DIRECTING RECESSES

BACKGROUND OF THE INVENTION

1. Field of the Invention

This invention relates generally to whirlpool baths and more particularly to whirlpool baths that can be retrofitted within a standard size bathtub space.

2. Description of the Prior Art

Retrofit whirlpool baths are known in the prior art. For example, in U.S. Pat. No. 3,739,924 R. A. Jacuzzi describes a hydromassage tub having an end provided with a relatively steep wall and with associated arm rests to provide comfortable back and arm supports for a person sitting in the tub. A water jet assembly is installed in the end of each arm rest to provide general hydromassage action and a jet assembly is installed in the relatively steep wall to provide hydromassage action directly to the back.

In U.S. Pat. No. 3,614,952 A. D. Agmellino discloses a bathtub which includes a pair of water jets in the end wall nearest the drain. U.S. Pat. No. 3,967,323 describes a constant flow bathtub having inlets located near the bottom of the tub and overflow outlets located near the top of the tub. U.S. Pat. Nos. 3,845,759, 3,874,374, and 4,139,001 all describe other types of whirlpool baths.

All known whirlpool baths include water jet nozzles mounted flush or almost flush with the walls or bottom of a tub. The water flowing from the nozzles quickly disperses within the body of water contained by the tub to produce a general turbulence within the water. Unfortunately, this general turbulence does not always produce the desired therapeutic or relaxing results.

One of the most desirable places for the soothing beat of the water jets to hit is on a person's back and shoulders. Jacuzzi recognized this fact when he included a water jet in the backrest of his tub so that an intense stream of water would hit a user's back. However, the jet of Jacuzzi's tub is focussed on only a small area of a person's back so that other portions of the back and neck only receive a weakened swirl of water.

What the prior art fails to show, then, is a whirlpool type bath which can provide intense, soothing hydromassage action over a large area of a person's back and neck.

SUMMARY OF THE INVENTION

It is an object of this invention to provide a whirlpool bath which can produce an intense, soothing hydromassage action over a large area of a person's back and neck.

It is another object of this invention to provide such a whirlpool bath which can be installed in a standard bathtub space.

Yet another object of this invention is to provide a whirlpool bath that is attractive, rugged, dependable and easy to manufacture.

Briefly, the invention comprises an oblong tub having sloped end wall sections and sloped sidewall sections smoothly merging into a generally oblong shaped bottom section. The end walls have a back supportive surface and a wedge shaped recessed surface. One of the end walls is also provided with a generally vertical, semi-tubular recessed surface which intersects the wedge shaped recessed surface. The recessed surfaces are provided with a pair of apertures receptive to hydromassage water jet nozzles. Water flowing out of the two nozzles react with each other and provide a swirling, turbulent hydromassaging flow of water which is directed and channeled by the recesses to the crucial areas of the back, spine and neck. The recesses are deeper and wider at the bottom than at the top to provide a substantially constant turbulence within the recessed area.

Jets are also provided in the sidewalls of the tub to provide general turbulence to the water and to massage the hip and leg areas. A suction port is provided on a side of the tub and a passive drain is recessed within the semi-tubularly shaped recess at the bottom of the tub. A water retaining lip flares away from the top of the wall sections.

An advantage of this invention is that a person can receive a highly efficient hydromassage over a large area of the neck and back.

Another advantage of this invention is that the whirlpool bath can be made to fit within a standard bathtub space.

Yet another advantage of this invention is its simplicity allowing for economical construction and high reliability.

These and other objects and advantages of the present invention will no doubt become apparent upon a reading of the following descriptions and a study of the several figures of the drawing.

IN THE DRAWING

DETAILED DESCRIPTION OF THE PREFERRED EMBODIMENTS

Figure 1:
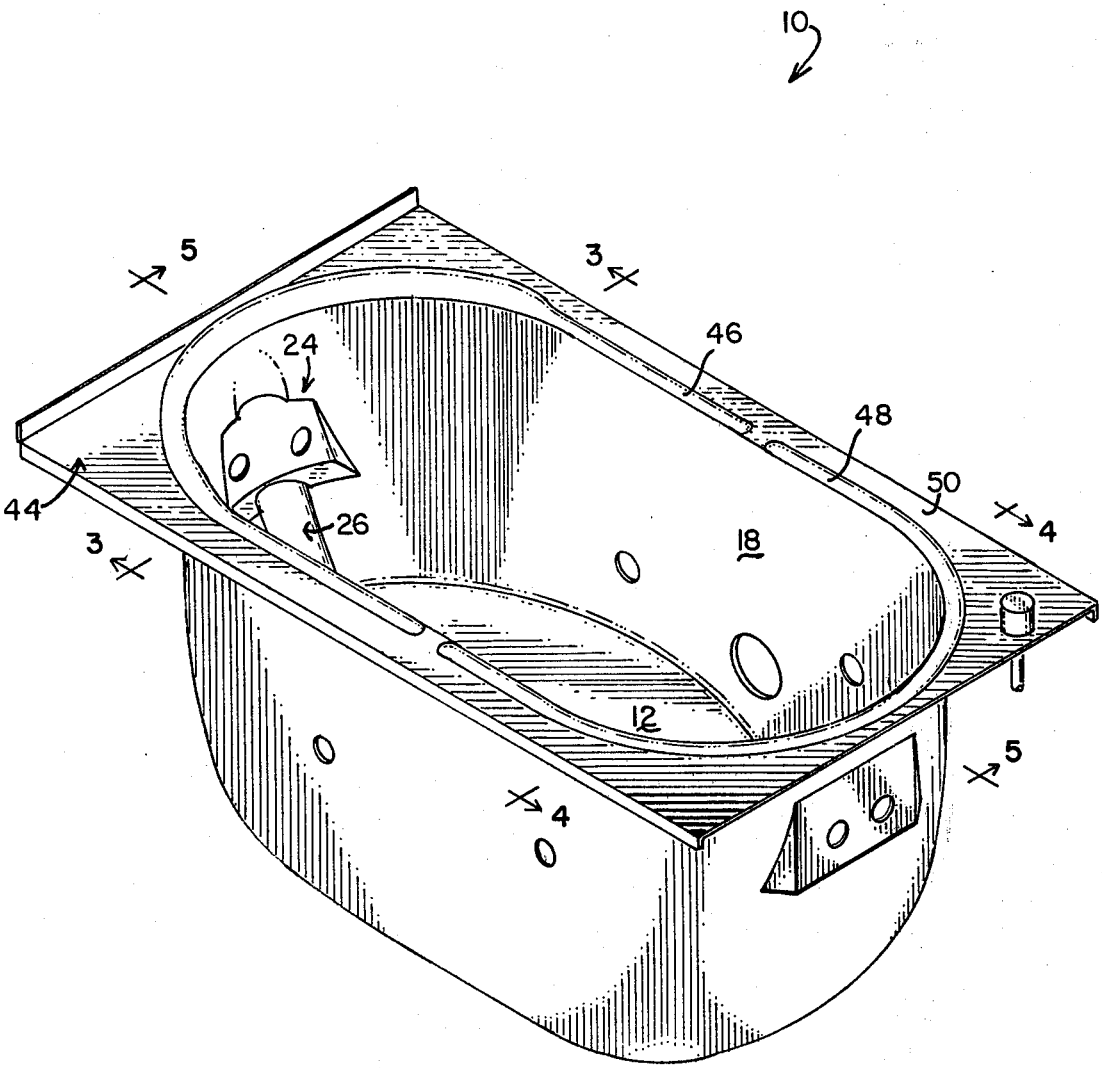
FIG. 1 is a perspective view of a retrofit whirlpool bath having flow directing recesses in accordance with the present invention.
Figure 2:
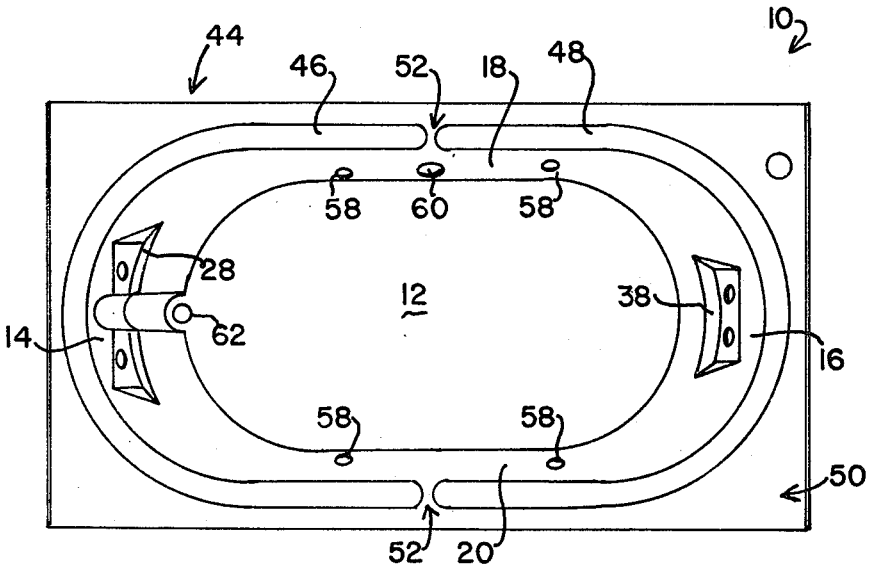
FIG. 2 is a top plan view of the whirlpool bath shown in FIG. 1.

Referring to the perspective view of FIG. 1 and the top plan view of FIG. 2, a whirlpool tub 10 in accordance with the present invention includes a bottom section 12 and four contiguous, upwardly and outwardly extending wall sections 14, 16, 18, and 20. As can be seen, the four wall sections and the bottom section merge smoothly together to create a generally oblong shaped tub having a gently sloping inner surface.

Figure 3:
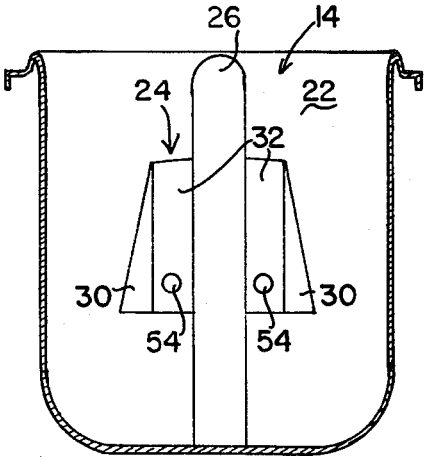
FIG. 3 is a cross-sectional view taken along line 3—3 of FIG. 1.
Figure 5:
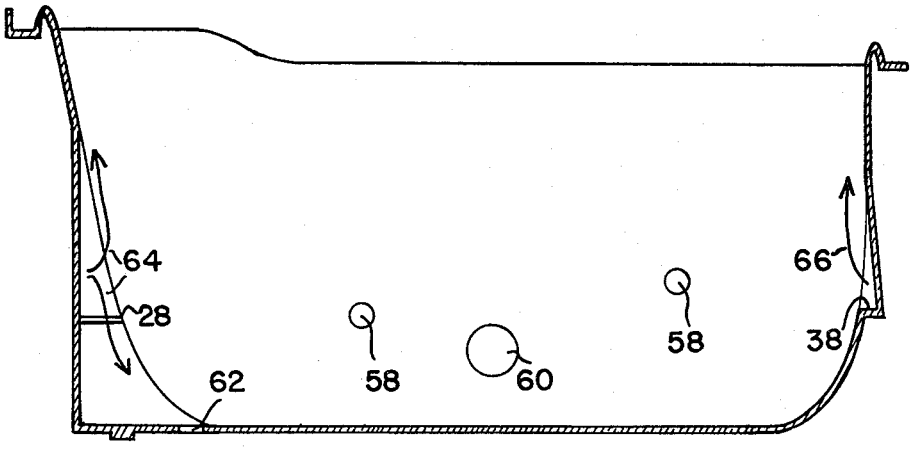
FIG. 5 is a cross-sectional view taken along line 5—5 of FIG. 1.

With added reference to FIG. 3, a first end wall section 14 includes a surface 22 which is supportive of a reclining person's back, a wedge shaped recessed surface 24, and a generally vertical, semi-tubularly shaped recessed surface 26 intersecting the recessed surface 24. The wedge shaped recessed surface includes a substantially horizontal ledge surface 28, two triangularly shaped side surfaces 30 and a back surface 32. As best seen in FIGS. 1 and 5, the recessed surface 24 is wider and deeper near its bottom than at its top. Likewise, recessed surface 26, which extends from nearly the top of the tub to the bottom surface, is deeper near the bottom than at the top.

Figure 4:
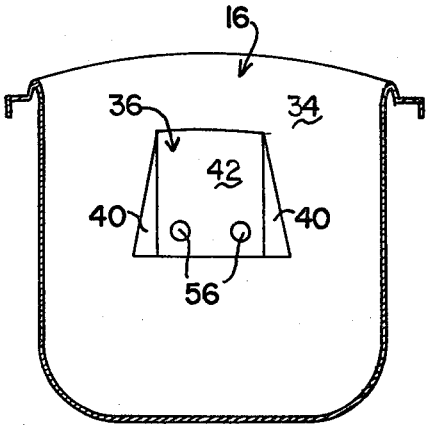
FIG. 4 is a cross-sectional view taken along line 4—4 of FIG. 1.

With reference to FIG. 4, a second end wall section 16 includes a surface 34 supportive of a user's back and a wedge shaped recess surface 36. The recessed surface 36 is similar to recessed surface 24 and includes a substantially horizontal ledge surface 38, two triangularly shaped side surfaces 40 and a back surface 42. Again, the recessed surface is wider and deeper near its bottom than near its top.

The upper edges of the wall sections are surrounded by a horizontally flaring lip section 44 including a pair of facing U shaped ridge sections 46 and 48, and a planar section 50. It will be noted that ridge section 46 near wall section 14 is raised above the level of ridge section 48. This greater height is necessitated to prevent overflow by water channeling up recessed surface 26. The ridge sections co-operate to retain the water within the tub but are slightly separated at 52 to allow any water splashed out of the tub to run back in.

A number of apertures are provided in the tub for the inflow or draining of water. Recessed surface 24 is provided with two apertures 54 which are receptive to water jet nozzles (not shown). Similarly, recessed surface 36 is provided with two apertures 56 which are receptive to nozzles. The tub is also provided with four more apertures 58 in the side wall sections which are receptive to water jet nozzles. Aperture 60 is a suction port and aperture 62 is a passive drain.

By recessing aperture 62 within semi-tubularly shaped recess 26 a person can comfortably sit directly over the drain. Furthermore, the recessed drain aperture allows the present tub to be installed with a "loop plumbing" system which is, as is well known to those skilled in the art, highly advantageous over other plumbing systems.

The jet nozzles at apertures 58 provide general agitation of the water within the tub and supply a certain degree of hip and leg massage for a person sitting in the tub. The interaction of water flowing from nozzles in apertures 54 and 56 can be best described with reference to FIG. 5.

In FIG. 5 arrows 64 indicate the direction in which water will flow from the jets if a person is reclining against supportive surface 22, and arrow 66 indicates the direction in which water will flow from the jets if a person is leaning against supportive surface 34. It will be noted that by leaning against a supportive surface a person's back co-operates with the recesses to form a channel through which the water must flow up the back and, in the case of recess 26, along the spine. The recesses of end wall section 14 thus direct the swirling, pulsating water across a broad area of the back and up and down the spine, and the recess of end wall section 16 direct the water flowing from the jet nozzles to the upper back.

The water flowing from the nozzles is, of course, at its highest velocity and pressure immediately upon entering the tub. By tapering the recesses the pressure can be more evenly distributed across the back. Furthermore, by providing two jet nozzles per recessed surface a strong, interactive turbulence is assured.

Finally, as seen in FIG. 1, an aperture can be provided in a corner of planar section 50 for an air control valve. All other controls, plumbing, and mechanisms associated with the tub can be hidden beneath the planar sections of the tub or behind the front skirting of the tub (not shown). The tub can further be provided with the necessary surface configurations to accept sliding glass doors, etc.

While this invention has been described in terms of a single preferred embodiment, it is contemplated that those reading this description and studying the drawing will realize various modifications and permutations thereof. It is therefore intended that the following appended claims be interpreted as including all such modifications and permutations as fall within the true spirit and scope of the present invention.

What is claimed is:

1. A retrofit whirlpool bath having flow directing recesses comprising:

a tub having an oblong bottom section and four, contiguous, upwardly and outwardly extending wall sections including a first end wall section having a first back supportive surface and a first wedge-shaped recessed surface extending back from said first back supportive surface and a generally vertical, semi-tubularly shaped surface extending back from said first supportive surface and intersecting said first wedge-shaped recessed surface, said first recessed surface being provided with a first aperture receptive to a water jet nozzle, said first wedge-shaped recessed surface including a first ledge surface for directing a flow of water up and against the back of a person leaning against said first supportive surface, a second end wall section having a second back supportive surface and a second wedge-shaped recessed surface extending back from said second back supportive surface, said second recessed surface being provided with a second aperture receptive to a water jet nozzle, said second wedge-shaped recessed surface including a second ledge surface for directing a flow of water up and against the back of a person leaning against said second supportive surface, and a pair of opposing side wall sections connecting said first end wall section and said second end wall section, wherein said bottom section and said four contiguous wall sections smoothly merge together to produce a contoured, oblong-shaped inner tub surface.

2. A retrofit whirlpool bath as claimed in claim 1 wherein said first recessed surface is wider and deeper proximate said first ledge surface than it is near its top, and wherein said second recessed surface is wider and deeper proximate said second ledge surface than it is near its top whereby water flow from said first aperture and said second aperture is substantially constant in pressure and turbulence within the confines of said first recessed surface and said second recessed surface, respectively.

3. A retrofit whirlpool bath as claimed in claim 2 wherein said first recessed surface is provided with a third aperture receptive to a water jet nozzle, and wherein said second recessed surface is provided with a fourth aperture receptive to a water jet nozzle whereby water flow from said first aperture and said third aperture can combine to produce a high pressure, turbulent flow within the confines of said first recessed surface, and whereby water flow from said second aperture and said fourth aperture can combine to produce a high pressure, turbulent flow within the confines of said second recessed surface.

4. A retrofit whirlpool bath as claimed in claim 3 wherein each of said pair of side wall sections is provided with at least one aperture receptive to a water jet nozzle.

5. A retrofit whirlpool bath as claimed in claim 4 wherein at least one of said side wall sections is provided with a suction port aperture.

6. A retrofit whirlpool bath as claimed in claim 5 wherein said bottom section is provided with a water drain aperture.

7. A retrofit whirlpool bath as claimed in claim 6 wherein said water drain aperture is recessed within a lower portion of said semi-tubularly shaped surface.

8. A retrofit whirlpool bath as claimed in claim 7 further including a lip section flaring away from the top of said four wall sections.

9. A retrofit whirlpool bath as claimed in claim 8 wherein said flaring lip section includes a pair of water retaining, facing, U shaped ridges.

10. A retrofit whirlpool bath as claimed in claim 9 wherein said lip section further includes a horizontal, planar portion surrounding said ridges and provided with at least one aperture receptive to an air flow control valve.

11. A retrofit whirlpool both having flow directing recesses comprising:

a tub having an oblong bottom section and four, contiguous upperwardly and outwardly extending wall sections including a first end wall end section having a first back supportive surface and a first wedge-shaped recess surface extending back from said first back supportive surface and a generally vertical, semi-tubularly shaped surface extending back from said first supportive surface and intersecting said first wedge-shaped recess surface, said first recess surface being provided with a first aperture receptive to a water jet nozzle, a second end wall having a second back supportive surface and a second wedge-shaped recessed surface extending back from said second back supportive surface, said second recess surface being provided with a second aperture receptive to a water jet nozzle, and a pair of opposing side wall sections connecting said first end wall section and said second end wall section, wherein said bottom section and said four contiguous wall sections smoothly merged together to produce a contoured, oblong inner tub surface.

* * * * *